US006655173B2

(12) United States Patent
Iritani et al.

(10) Patent No.: US 6,655,173 B2
(45) Date of Patent: Dec. 2, 2003

(54) EVAPORATOR FOR REFRIGERATING MACHINE AND REFRIGERATION APPARATUS

(75) Inventors: Yoichiro Iritani, Kobe (JP); Akihiro Kawada, Kako-gun (JP); Yoshinori Shirakata, Nagoya (JP); Wataru Seki, Nishikasugai-gun (JP); Koji Hirokawa, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/169,759

(22) PCT Filed: Sep. 5, 2001

(86) PCT No.: PCT/JP01/07686

§ 371 (c)(1),
(2), (4) Date: Jul. 19, 2002

(87) PCT Pub. No.: WO02/42696

PCT Pub. Date: May 30, 2002

(65) Prior Publication Data

US 2003/0000246 A1 Jan. 2, 2003

(30) Foreign Application Priority Data

Nov. 24, 2000 (JP) ..... P2000-357022

(51) Int. Cl.[7] ..... F25B 39/02

(52) U.S. Cl. ..... 62/515; 62/219; 62/524; 62/471; 62/498; 62/470

(58) Field of Search ..... 62/524, 219, 471, 62/470, 515, 498

(56) References Cited

U.S. PATENT DOCUMENTS

| | | | | | |
|---|---|---|---|---|---|
| 3,744,264 | A | * | 7/1973 | Ware | 62/115 |
| 4,354,551 | A | * | 10/1982 | Kristoffersson et al. | 165/166 |
| 4,365,487 | A | * | 12/1982 | Dobney | 62/498 |
| 4,823,561 | A | * | 4/1989 | Medlock | 62/513 |
| 5,435,155 | A | * | 7/1995 | Paradis | 62/515 |
| 6,516,627 | B2 | * | 2/2003 | Ring et al. | 62/471 |

FOREIGN PATENT DOCUMENTS

| | | |
|---|---|---|
| JP | 8-189726 | 7/1996 |
| JP | 8-233407 | 9/1996 |

* cited by examiner

*Primary Examiner*—William C. Doerrler
*Assistant Examiner*—Mark Shulman
(74) *Attorney, Agent, or Firm*—Oblon, Spivak, McClelland, Maier & Neustadt, P.C.

(57) ABSTRACT

An evaporator for a refrigerating system which prevents droplets of refrigerant from blowing upwards, and a refrigeration apparatus using thereof are provided. The evaporator for a refrigerating system includes a container into which the refrigerant is introduced, and heat exchanger tubes disposed in the container through which a cooled object flows. The evaporator further includes a prevention plate disposed above the heat exchanger tubes so that droplets of the refrigerant, which are blown upwards due to a boiling of the refrigerant, hit the prevention plate.

12 Claims, 6 Drawing Sheets

EVAPORATOR FOR REFRIGERATING MACHINE AND REFRIGERATION APPARATUS

TECHNICAL FIELD

The present invention relates to an evaporator for a refrigerating system which refrigerates an object to be cooled (e.g., water, brine, etc.) by exchanging heat between the object and the refrigerant, and a refrigeration apparatus using the evaporator.

BACKGROUND ART

In a structure of large scale, such as a tall building, cool water, which has been chilled by a refrigerating system, is circulated through a pipe arrangement disposed in the structure so that heat is exchanged between the cool water circulating in the pipe arrangement and air present in the spaces of the structure to decrease the temperature of the spaces.

FIG. 8 is a diagram showing an example of a conventional evaporator which may be provided with a refrigerator. In this evaporator, a plurality of bundles of heat exchanger tubes 2 through which water passes is disposed in a staggered form in a cylindrical container 1 into which a refrigerant is introduced.

The plurality of heat exchanger tubes 2 may be divided into two groups, namely, a group of entering tubes which communicate with a water entrance 3 and a group of exiting tubes which communicate with a water exit 4. Water enters from the water entrance 3, passes through heat exchanger tubes 2 of the entering tube group in the container 1 to reach a water chamber (not shown in the figure), and then passes through the heat exchanger tubes 2 of the exiting tube group to exit from the water exit 4. During this process, water is cooled down by heat exchange with the refrigerant introduced into the container 1, and the refrigerant which received heat from the water, in turn, boils and vaporizes.

The vaporized refrigerant is then compressed in a compressor, which is not shown in the figure, and transferred to a condenser.

In the above-mentioned type of evaporator, however, when the refrigerant is boiled around the heat exchanger tubes 2 and vapor is generated, droplets of the refrigerant are often blown upwards by the force of the refrigerant vapor. Then, some of these droplets of refrigerant are sometimes drawn into the above-mentioned compressor and cause problems, such as a decrease in the performance of the compressor or damage to an impeller.

Although attempts have been made to create open passages (i.e., spaces among heat exchanger tubes) along the bundle of the heat exchanger tubes in an up-and-down direction as pathways for bubbles generated when the refrigerant boils, the force of the refrigerant vapor blown upwards from the opening of the passages is increased in this case.

Accordingly, one of the objects of the present invention is to provide an evaporator for a refrigerating system, which is capable of preventing blown upwards of droplets of the refrigerant, and a refrigeration apparatus using the evaporator.

DISCLOSURE OF INVENTION

The present invention provides an evaporator for a refrigerating system including a container into which a refrigerant is introduced, and heat exchanger tubes disposed in the container through which an object to be cooled down flows, comprising: a prevention plate disposed above the heat exchanger tubes so that droplets of the refrigerant, which are blown upwards due to boiling of the refrigerant, hit the prevention plate and are prevented from proceeding beyond the prevention plate.

In accordance with another aspect of the invention, the heat exchanger tubes are divided into a plurality of vertically spaced groups so that a space is formed between the groups of the heat exchanger tubes in vertical direction; and the prevention plate is disposed above the space.

In yet another aspect of the invention, the distance between the prevention plate and the heat exchanger tubes at an uppermost level is about 0.5 to 2 times the diameter of a heat exchanger tube which is located at the uppermost level.

In yet another aspect of the invention, the prevention plate has a cross section shaped like an inverted letter "V", "U", "W", etc., and the angle of the prevention plate is designed to be between about 60° and 120°.

In yet another aspect of the invention, an end portion of the prevention plate covers at least a part, preferably, half or all, of a heat exchanger tube which is located at the uppermost level of the heat exchanger tubes and is adjacent to the prevention plate.

In yet another aspect of the invention, a group of the heat exchanger tubes facing an inner surface of the container is disposed so that a space is formed between the group of the heat exchanger tubes and the container along the inner surface of the container; and a prevention plate is disposed above the space.

The present invention also provides a refrigeration apparatus, comprising: a compressor for compressing a refrigerant; a condenser for condensing and liquefying the refrigerant which is compressed in the compressor; a throttling mechanism for reducing the pressure of the liquefied refrigerant; and an evaporator for cooling down an object to be cooled by exchanging heat between the object to be cooled and a resultant condensed and pressure-reduced liquefied refrigerant, and evaporating and vaporizing the liquefied refrigerant, wherein the evaporator is one of the above-mentioned evaporators.

BEST MODE FOR CARRYING OUT THE INVENTION

The evaporator for a refrigerating system according to embodiments of the present invention will be described with reference to the accompanying drawings.

Figure 1:
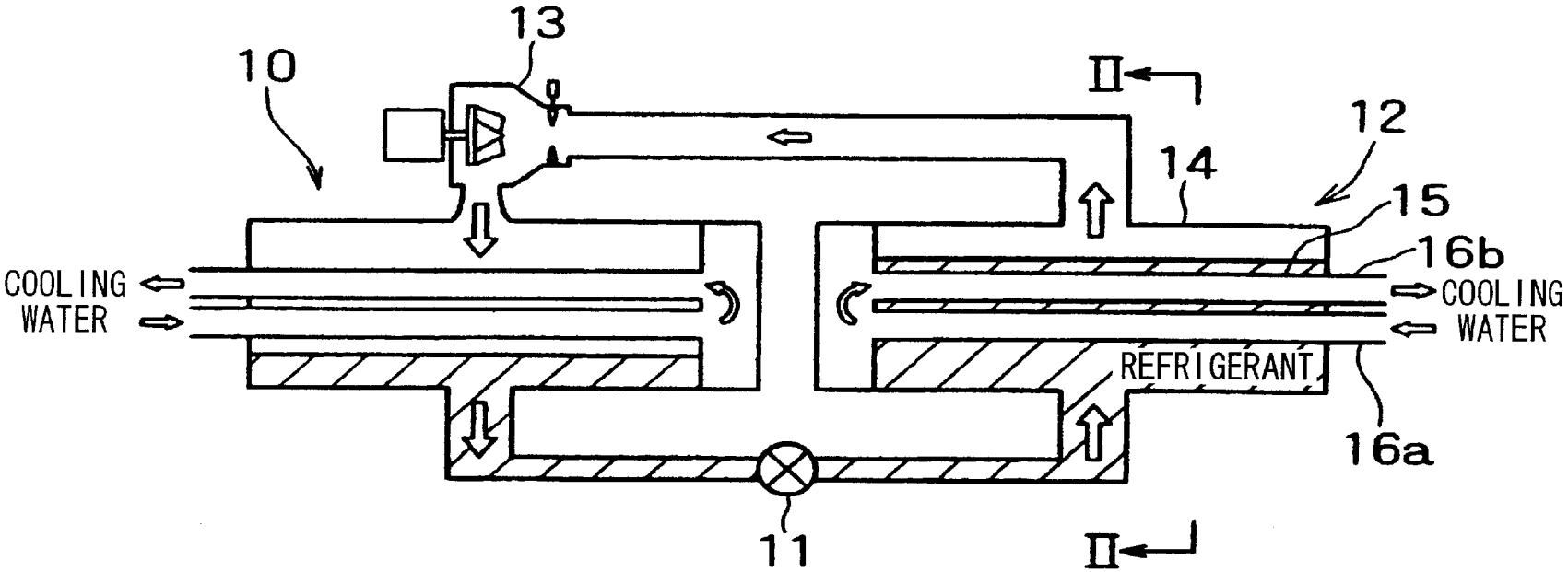
FIG. 1 is a diagram showing a schematic structure of a refrigerating system to which an evaporator according to an embodiment of the present invention may be applied.

FIG. 1 is a diagram showing a schematic structure of a refrigerating system according to an embodiment of the present invention. The refrigerating system includes a condenser 10, an expansion valve (throttle valve) 11, an evaporator 12, and a compressor 13. The condenser 10 condenses and liquefies a refrigerant by exchanging heat between cooling water (the cooled object) and the refrigerant which may be in a vapor phase. The expansion valve 11 decreases the pressure of the condensed refrigerant. The evaporator 12 refrigerates the cooling water by exchanging heat between the cooling water and the condensed refrigerant. The compressor 13 compresses the refrigerant, which has been evaporated and vaporized in the evaporator 12, and supplies it to the above-mentioned condenser 10. The cooling water refrigerated in the evaporator 12 may be utilized, for instance, for air-conditioning in a building.

Figure 2:
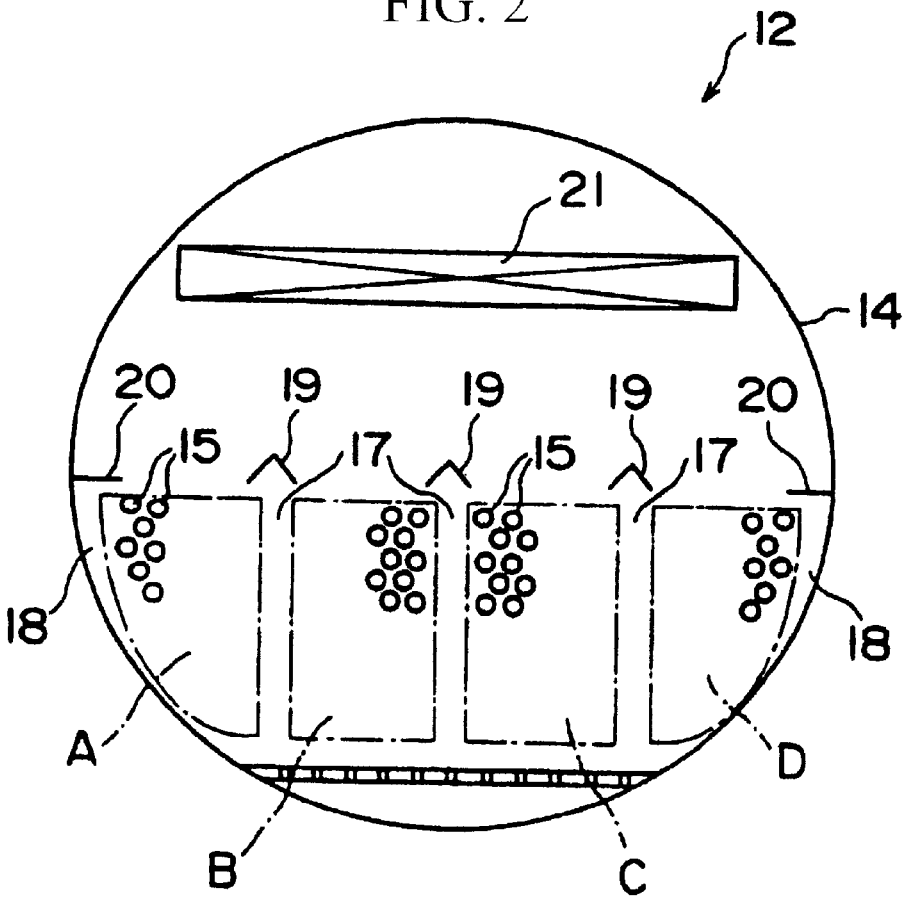
FIG. 2 is a diagram showing a cross-sectional view of the refrigerating system shown in FIG. 1 cut along the II—II line.

FIG. 2 is a diagram showing a cross-sectional view of the refrigerating system shown in FIG. 1 cut along the II—II line indicated by arrows. As shown in FIG. 2, the evaporator 12 includes a cylindrical container 14 into which a refrigerant is introduced, and a plurality of bundles of heat exchanger tubes 15 disposed in the container 14.

The plurality of heat exchanger tubes 15 is disposed in the longitudinal direction (i.e., a vertical direction with respect to the sheet surface of FIG. 2) of the container 14 and function as pathways for cooling water, which is the cooled object. The heat exchanger tubes 15 are divided into groups, namely, a group of entering tubes which communicate with a cooling water entrance 16*a* and a group of exiting tubes which communicate with a cooling water exit 16*b* shown in FIG. 1. The direction of the flow of cooling water in the heat exchanger tubes 15 communicating with the cooling water entrance 16*a* is different from the direction of the flow of cooling water in the heat exchanger tubes 15 communicating with the cooling water exit 16*b*.

The plurality of heat exchanger tubes 15 may be divided into a plurality of groups, for instance, four, (i.e., groups of tubes A–D as shown in FIG. 2) in the lower half of the container 14. A space 17 is formed between each of the groups A–D of the heat exchanger tubes 15 in a vertical direction, and a space 18 is formed between the group A and the container 14 along the inner surface of the container 14, and between the group D and the container 14 along the inner surface of the container 14. Note that the above-mentioned spaces 17 and 18 are hereinafter referred to as passages 17 and 18 since it may be regarded that they are formed by extracting the corresponding heat exchanger tubes 15 which may be present there originally.

A prevention plate 19 having an inverted "V" cross sectional shape is disposed above each of the passage 17. Also, a blow-up prevention plate 20, which may have a flat shape, is disposed above each of the passage 18. The shape of the prevention plates 19 and 20 is not particularly limited, and any suitable shape, such as inverted "U" and "W", can be used.

Figure 3:
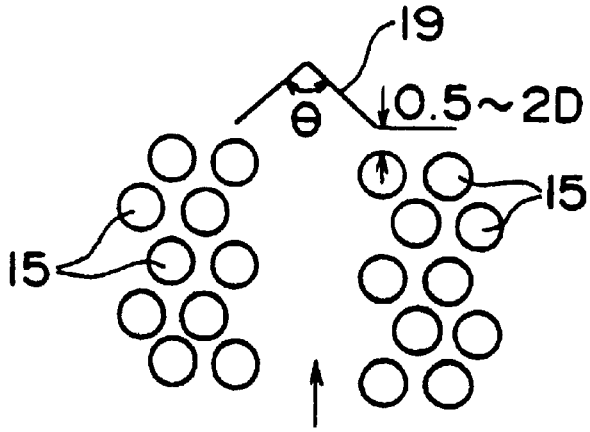
FIG. 3 is a diagram showing a partial enlarged cross-sectional view of the arrangement of a prevention plate having a cross section substantially shaped as an inverted letter "V".

As shown in the enlarged view of FIG. 3, the vertical angle θ of the prevention plate 19 in this embodiment is designed to be between about 60° and 120°. The prevention plate 19 is disposed at a position above the passage 17 so that the right and left portions, respectively, of the prevention plate 19 cover at least a part, preferably, half or all, of the corresponding adjacent heat exchanger tube 15 at the uppermost level, and that the distance between the right and left edge portions, respectively, of the prevention plate 19 and the corresponding heat exchanger tube 15 be 0.5 to 2 times the diameter D of the heat exchanger tube 15.

Figure 4:
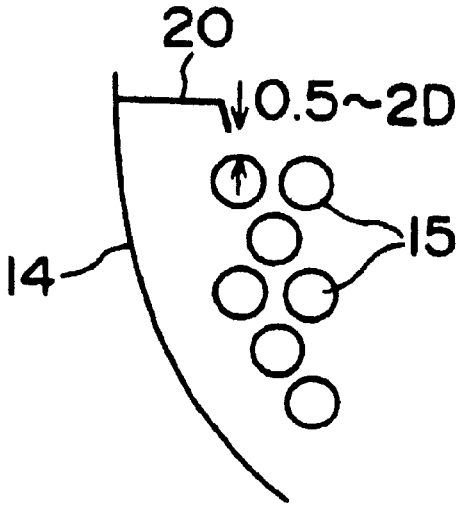
FIG. 4 is a diagram showing a partial enlarged cross-sectional view of the arrangement of a flat prevention plate.

On the other hand, as shown in the enlarged view of FIG. 4, the prevention plate 20 is disposed above the heat exchanger tube 15 so that the edge portion thereof covers at least a part of the corresponding adjacent heat exchanger tube 15 at the uppermost level, and that the distance between the edge portion of the prevention plate 19 and the corresponding heat exchanger tube 15 be 0.5 to 2 times the diameter D of the heat exchanger tube 15.

Note that although the end portion of the prevention plate 20 is downwardly bent in order to stop the upward flow from the passage 18 in the above embodiment, the prevention plate 20 may have a flat shape and no problems would be caused by the use of such a prevention plate 20.

The number of the heat exchanger tubes 15 contained in the groups A–D in the above embodiment may be chosen to be, for instance, five hundreds. Also, the heat exchanger tubes 15 in each of the groups A–D may be arranged in a staggered manner. That is, the heat exchanger tubes 15 at an upper level are shifted by about half of the distance, i.e., ½ offset, between each other in the transverse direction with respect to the heat exchanger tubes 15 at the next lower level.

In the evaporator 12 having the above-mentioned configuration, the refrigerant is introduced into the container 14 via a lower portion thereof. Since the refrigerant boils when heat is exchanged between cooling water flowing through the heat exchanger tubes 15 and itself, vapor of the refrigerant is generated around the heat exchanger tubes 15, which are mainly located at a lower portion of each of the groups A–D, and rises to the surface through the passages 17 or 18.

Although the vapor and droplets of refrigerant bubbles up vigorously from the opening of the passages 17, the ascent rate thereof is significantly reduced when the vapor and droplets hit the above-mentioned prevention plates 19 and 20.

As a result, only the vapor of the evaporated refrigerant exits the container 14 via the demister 21. That is, it becomes possible to prevent the droplets of refrigerant from being supplied to the compressor 13 shown in FIG. 1. Note that the above-mentioned vapor of the refrigerant is supplied to the compressor 13 and is compressed.

As mentioned above, according to the evaporator of this embodiment of the present invention, since the prevention plates 19 and 20 prevent the droplets of refrigerant being blown upwards beyond the plates 19 and 20 in the container 14, the droplets of refrigerant are not drawn into the compressor 13. Accordingly, it becomes possible to avoid problems, such as a decrease in the performance of the compressor or damage to an impeller.

Figure 5:
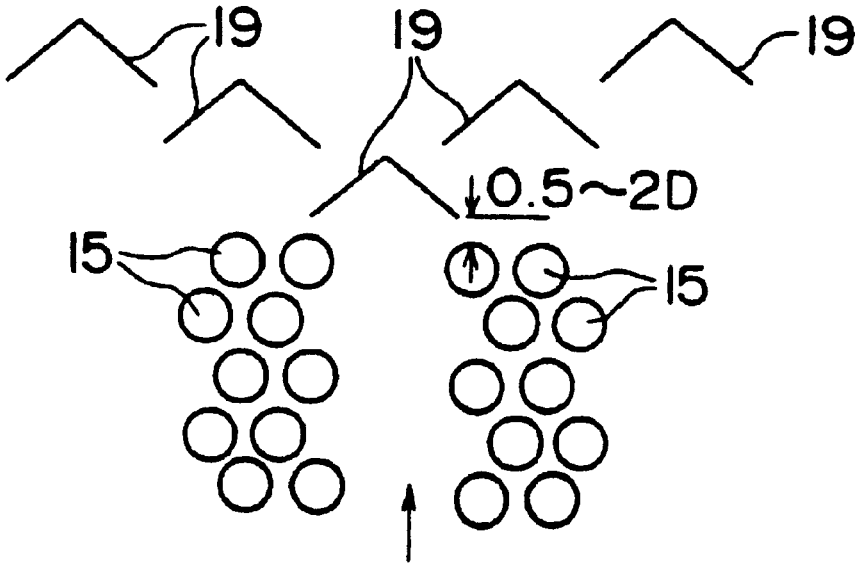
FIG. 5 is a diagram showing a partial enlarged cross-sectional view of the arrangement of a plurality of the prevention plates.

Note that although the prevention plates 19 and 20 are disposed only above the passages 17 and 18 in the above-mentioned embodiments, droplets of refrigerant may sometimes be blown upwards by bubbles of the refrigerant which ascend between the heat exchanger tubes 15 in each of the groups A–D. Accordingly, the prevention plates 19 may be disposed so as to cover all of the heat exchanger tubes 15 of the groups A–D as shown in FIG. 5. In this manner, it becomes possible to assuredly prevent the droplets of refrigerant from entering the compressor 13.

In this embodiment, although each of the prevention plates 19 is disposed so as to be vertically shifted relative to each other and to overlap, when viewed from the above, with adjacent prevention plates 19, it is possible to arrange the prevention plates 19 in a different manner.

Also, although the passages 17 and 18 are provided in order to decrease the amount of bubbles in each of the tube groups A–D in the evaporator 12 according the above-mentioned embodiments, the present invention, which can prevent the droplets of refrigerant from blowing upwards, may also be effectively and suitably applied to an evaporator having no passages 17 and 18.

The heat exchanger tubes 15 are arranged in the staggered manner in each of the groups A–D in the above-mentioned embodiments to enhance the contact between the refrigerant and the heat exchanger tubes 15 and to improve the heat transfer rate between them.

Figure 6:
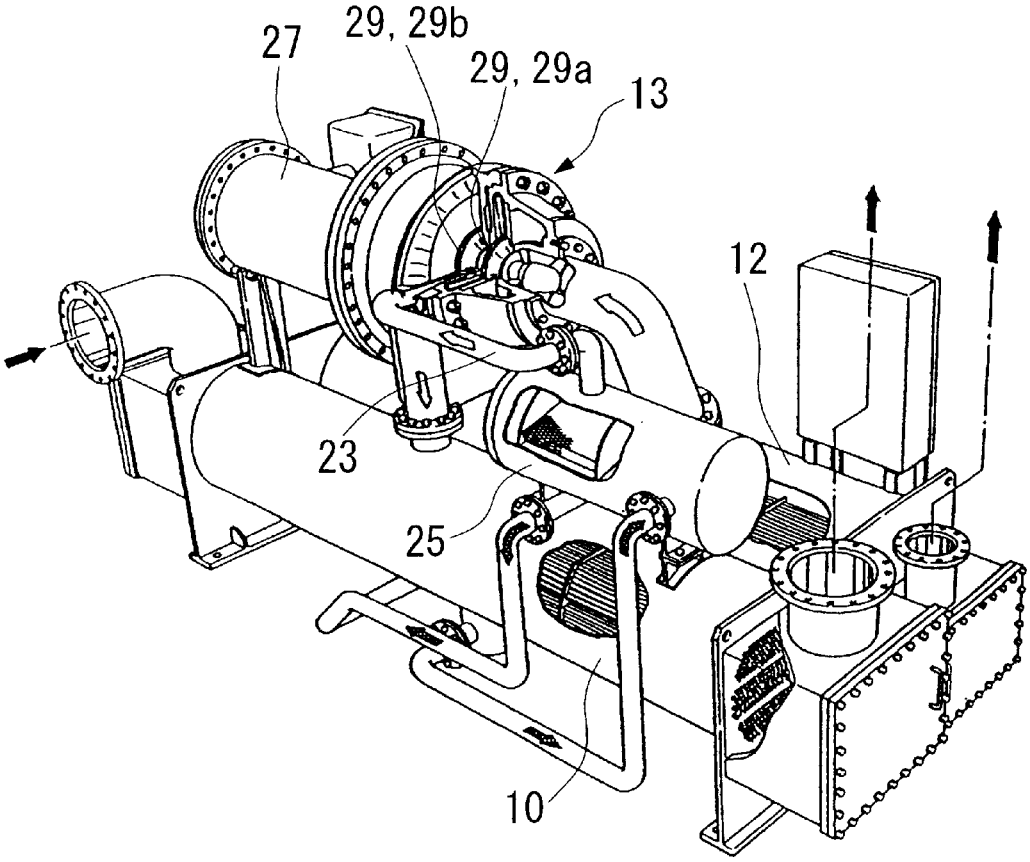
FIG. 6 is a perspective view to explain the structure and construction of an evaporator in a refrigeration apparatus according to an embodiment of the present invention.
Figure 7:
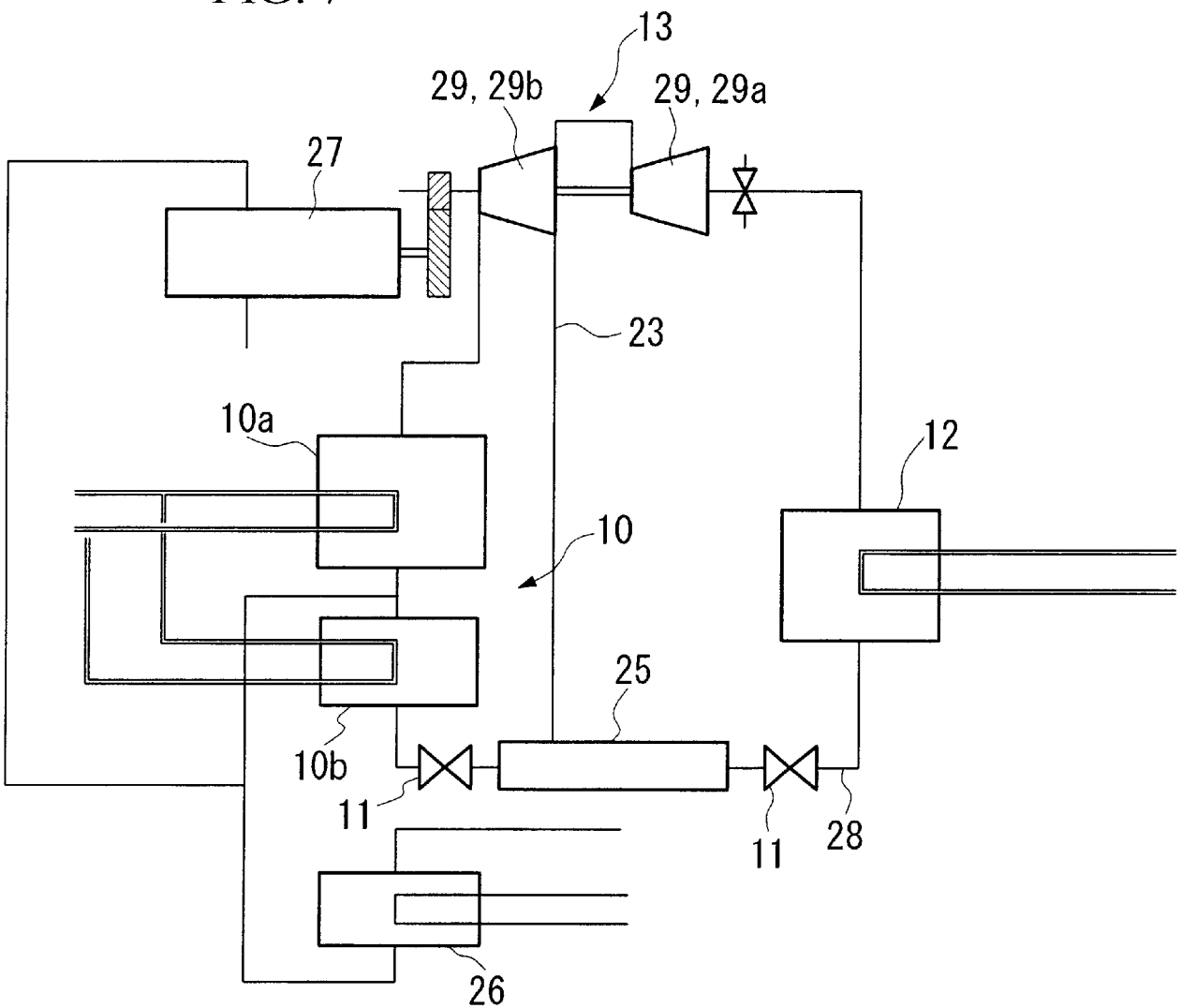
FIG. 7 is a schematic piping diagram to explain the configuration of the evaporator in the refrigeration apparatus according to an embodiment of the present invention.
Figure 8:
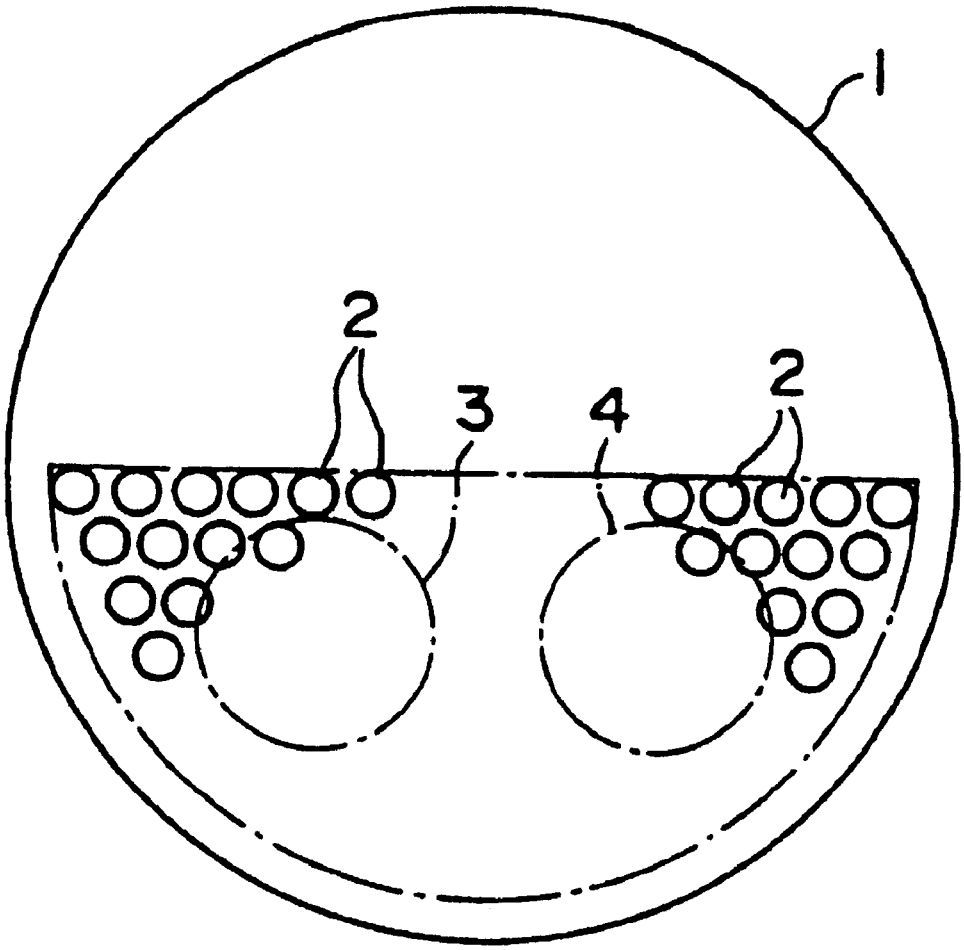
FIG. 8 is a diagram showing an example of a conventional evaporator which may be provided with a refrigerator.

Next, the overall structure of a refrigeration apparatus including the above-mentioned evaporator according to an embodiment of the present invention will be explained with reference to FIGS. 6 and 7.

The refrigeration apparatus shown in the figures includes the above-mentioned evaporator 12; a compressor 13 for compressing the refrigerant vaporized in the evaporator 12; a condenser 10 for condensing and liquefying the refrigerant compressed in the compressor 13; an expansion valve (throttle valve) 11 for reducing the pressure of the refrigerant liquefied in the condenser 10; an intermediate cooler 25 for temporarily storing and cooling the refrigerant liquefied in the condenser 10; and an oil cooler 26 for cooling the lubricating oil for the compressor 13 by utilizing a portion of the refrigerant cooled in the condenser 13.

Also, a motor (a driving mechanism) 27 is connected to the compressor 13 for operating the compressor 13.

The condenser 10, the throttle valve 11, the evaporator 12, the compressor 13, and the intermediate cooler 25 are connected via primary piping 28 to constitute a closed system in which the refrigerant is circulated.

The compressor 13 in this embodiment is based on a 2-stage (multistage) centrifugal compressor, a so-called turbo compressor, and this turbo compressor 13 is provided with a plurality of impellers 29. The refrigerant is compressed in a first stage impeller 29*a* situated in the upstream side of the impeller 29, and the compressed refrigerant is led into the second stage impeller 29*b* to be compressed further and then sent to the condenser 10.

The condenser 10 includes a main condenser 10*a* and a sub-cooler 10*b* which is an auxiliary compressor, and the refrigerant is introduced first into the main condenser 10*a* and then to the sub-cooler 10*b*. However, a portion of the refrigerant cooled in the main condenser 10*a* is introduced into the oil cooler 26, without passing through the sub-cooler 10*b*, to cool the lubricating oil.

Also, apart from the above process, a portion of the refrigerant cooled in the main condenser 10*a* is introduced into the casing 31 of the motor 27, which will be explained later, without passing through the sub-cooler 10*b*, and cools stators and coils which are not shown in the diagram.

The throttle valve 11 is disposed between the condenser 10 and the intermediate cooler 25, and between the intermediate cooler 25 and the evaporator 12, and they are used for stepwise reduction of the pressure of the refrigerant liquefied in the condenser 10.

The structure of the intermediate cooler 25 is equivalent to a hollow vessel, and the refrigerant which has been cooled in the main condenser 10*a* and the sub-cooler 10*b* and reduced in pressure in the throttle valve 11, is temporarily stored therein and is subjected to further cooling. Here, the vapor phase components in the intermediate cooler 25 are introduced into the second stage impeller 29*b* of the compressor 13 through the bypass piping 23, without passing through the evaporator 12.

INDUSTRIAL APPLICABILITY

According to the evaporator of the present invention, since the prevention plates are disposed above the heat exchanger tubes so that droplets of refrigerant, which are blown upwards when the refrigerant is boiled, hit the prevention plates, the droplets of refrigerant are not drawn into the compressor. Accordingly, it becomes possible to avoid problems caused by the droplets, such as a decrease in the performance of the compressor or damage to an impeller.

What is claimed is:

1. An evaporator for a refrigerating system including a container into which a refrigerant is introduced, and heat exchanger tubes disposed in the container through which an object to be cooled down flows, comprising:

a prevention plate disposed above said heat exchanger tubes so that droplets of the refrigerant, which are blown upwards due to boiling of the refrigerant, hit said prevention plate.

2. An evaporator for a refrigerating system according to claim 1, wherein said heat exchanger tubes are divided into a plurality of vertically spaced groups so that a space is formed between the groups of said heat exchanger tubes in a vertical direction; and said prevention plate is disposed above the space.

3. An evaporator for a refrigerating system according to claim 1, wherein the distance between said prevention plate and said heat exchanger tubes at an uppermost level is about 0.5 to 2 times the diameter of a heat exchanger tube which is located at the uppermost level.

4. An evaporator for a refrigerating system according to claim 1, wherein said prevention plate has a cross section substantially shaped as an inverted letter "V", and a vertical angle of said prevention plate is designed to be between 60° and 120°.

5. An evaporator for a refrigerating system according to claim 1, wherein an end portion of said prevention plate covers at least a part of a heat exchanger tube which is located at the uppermost level of said heat exchanger tubes and is adjacent to said prevention plate.

6. An evaporator for a refrigerating system according to claim 1, wherein a group of said heat exchanger tubes facing an inner surface of said container is disposed so that a space is formed between the group of said heat exchanger tubes and said container along the inner surface of said container; and said prevention plate is disposed above said space.

7. A refrigeration apparatus, comprising:

a compressor for compressing a refrigerant;

a condenser for condensing and liquefying the refrigerant which is compressed in said compressor;

a throttling mechanism for the pressure of the liquefied refrigerant; and an evaporator for cooling down an object to be cooled by exchanging heat between the object to be cooled and a resultant condensed and pressure-reduced liquefied refrigerant, and evaporating and vaporizing the liquefied refrigerant, wherein said evaporator comprises:

a container into which the refrigerant is introduced;

heat exchanger tubes disposed in the container through which the object to be cooled down flows; and a prevention plate disposed above said heat exchanger tubes so that droplets of the refrigerant, which are blown upwards due to boiling of the refrigerant, hit said prevention plate.

8. A refrigeration apparatus according to claim 7, wherein said heat exchanger tubes are divided into a plurality of vertically spaced groups so that a space is formed between the groups of said heat exchanger tubes in a vertical direction, and said prevention plate is disposed above the space.

9. A refrigeration apparatus according to claim 7, wherein the distance between said prevention plate and said heat exchanger tubes at an uppermost level is about 0.5 to 2 times the diameter of a heat exchanger tube which is located at the uppermost level.

10. A refrigeration apparatus according to claim 7, wherein said prevention plate has a cross section substantially shaped as an inverted letter "V", and a vertical angle of said prevention plate is designed to be between 60° and 120°.

11. A refrigeration apparatus according to claim 7, wherein an end portion of said prevention plate covers at least a part of a heat exchanger tube which is located at the uppermost level of said heat exchanger tubes and is adjacent to said prevention plate.

12. A refrigeration apparatus according to claim 7, wherein a group of said heat exchanger tubes facing an inner surface of said container is disposed so that a space is formed between the group of said heat exchanger tubes and said container along the inner surface of said container; and said prevention plate is disposed above said space.

* * * * *